US006942551B2

(12) United States Patent
Mizek et al.

(10) Patent No.: US 6,942,551 B2
(45) Date of Patent: Sep. 13, 2005

(54) METHOD FOR FORMING A CUTTING EDGE ALONG AN EDGE PORTION OF A BLADE STOCK

(75) Inventors: Robert S. Mizek, Downers Grove, IL (US); Frank A. Harwath, Naperville, IL (US); Miroslav A. Simo, Riverside, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/722,772

(22) Filed: Nov. 26, 2003

(65) Prior Publication Data

US 2005/0113003 A1 May 26, 2005

(51) Int. Cl.[7] ..... B24B 1/00

(52) U.S. Cl. ..... 451/45; 451/28; 451/177; 451/179; 451/193; 451/212; 451/214; 451/229; 451/371; 451/403

(58) Field of Search ..... 451/28, 45, 177, 451/179, 193, 212, 214, 229, 371, 403

(56) References Cited

U.S. PATENT DOCUMENTS 3,881,889 A * 5/1975 Hunkeler ..... 451/48
4,381,866 A * 5/1983 Simo ..... 473/584
4,653,373 A * 3/1987 Gerber ..... 83/697

* cited by examiner

*Primary Examiner*—Joseph J. Hail, III
*Assistant Examiner*—Shantese McDonald
(74) *Attorney, Agent, or Firm*—Pauley Petersen & Erickson

(57) ABSTRACT

A method for forming a cutting edge along an edge portion of a blade stock, wherein the method includes moving the blade stock with respect to a first cutting element rotating about a first rotational axis, the first rotational axis forming one of an acute angle and a perpendicular angle with respect to the cutting edge, and contacting the edge portion and the first cutting element and forming a first cutting surface along the edge portion. The method may also include moving the blade stock with respect to a second cutting element rotating about a second rotational axis, the second rotational axis forming one of an acute angle and a perpendicular angle with respect to the cutting edge, and contacting the edge portion and the second cutting element and forming a second cutting surface along the edge portion so that the second cutting surface intersects the first cutting surface to form the cutting edge. In one embodiment of this invention, at least one of the first rotational axis and the second rotational axis is oriented in a skewed position with respect to a line of the edge portion or a line tangent to an arc segment of the edge portion.

39 Claims, 17 Drawing Sheets

METHOD FOR FORMING A CUTTING EDGE ALONG AN EDGE PORTION OF A BLADE STOCK

BACKGROUND OF THE INVENTION

1. Field of the Invention

This invention relates to a method for forming a cutting edge along an edge portion of a blade stock. More specifically, this invention relates to a method for forming a cutting edge on an edge portion of an arrowhead blade having a first cutting surface and a second cutting surface intersecting the first cutting surface to form the cutting edge.

2. Description of Related Art

Conventional methods for forming a cutting edge along an edge portion of a blade typically includes passing a blade through a grinding apparatus having two opposing grinding wheels. Each grinding wheel rotates about an axis that is generally parallel to the edge portion of the blade on which the cutting edge is formed. For example, as shown in FIGS. 1–4, a cutting wheel 1 may be positioned with respect to the blade 2 and rotatable about a rotational axis 3. The cutting wheel 1 contacts the blade surface as it rotates about the rotational axis. Because the rotational axis 3 of the cutting wheel 1 is generally parallel to the edge of the blade 2, the cutting wheel 1 forms a nonplanar blade surface along the edge of the blade having an arcuate-shaped cross-section profile. Additionally, because of its positioning with respect to the blade 2, the cutting wheel 1 typically provides undesirable grinding lines which are generally aligned perpendicular to the edge portion of the blade. The conventional nonplanar blade surfaces and/or the perpendicular grinding lines can negatively effect the performance of the arrowhead by increasing drag and/or frictional interference.

Thus, there is an apparent need for a method for forming a cutting edge along an edge portion of a blade stock that forms a cutting edge with reduced drag and/or reduced frictional interference.

SUMMARY OF THE INVENTION

A general object of this invention is to provide an archery arrowhead blade having an improved cutting edge and associated or corresponding methods for making the blade cutting edge.

A more specific objective of this invention is to overcome one or more of the problems associated with conventional archery arrowhead blades and conventional methods for forming a cutting edge, such as described above.

The above and other objects of this invention are accomplished in one preferred embodiment of this invention with a method for forming a cutting edge along an edge portion of a blade stock. The blade stock may be a material, such as a metal, graphite or composite material, from which an archery arrowhead blade is made or may be a preformed archery arrowhead blade. The blade stock is moved with respect to a first cutting element rotating about a first rotational axis, which forms one of an acute angle and a perpendicular angle with respect to a cutting edge formed along an edge portion of the blade stock. The blade stock can move with respect to the first cutting element in a linear path or a nonlinear path, such as an arcuate or curved path. Further, relative movement between the blade stock and the cutting element may include moving the blade stock with the cutting element in a stationary position, moving the cutting element with the blade stock in a stationary position and moving each of the blade stock and the cutting element. The edge portion contacts the first cutting element and forms a first cutting surface along the edge portion.

The blade stock is also moved with respect to a second cutting element rotating about a second rotational axis, which forms an acute angle or a perpendicular angle with respect to the cutting edge. The edge portion contacts the second cutting element and forms a second cutting surface along the edge portion on a second blade surface of the blade stock, so that the second cutting surface intersects the first cutting surface to form the cutting edge. The blade stock may be moved with respect to the first cutting element to form the second cutting surface as an alternative to using a second cutting element. For example, the second blade surface may be positioned to contact the first cutting element to form the second cutting surface thereon.

The cutting edge is formed of the first cutting surface and the second cutting surface, each of which can form a planar or flat surface or a non-planar surface, such as an arcuate or curved surface. In one preferred embodiment of this invention, each of the first cutting surface and the second cutting surface forms a generally smooth surface. Alternatively, at least one of the first cutting surface and the second cutting surface can form a plurality of striations along a length of the cutting surface generally parallel to the cutting edge.

In one preferred embodiment of this invention, a method for forming a cutting edge along an edge portion of a blade stock includes forming the first cutting surface parallel to the first rotational axis in a plane. Preferably, but not necessarily, the first cutting element rotates about the first rotational axis generally perpendicular to the cutting edge. A working surface of the first cutting element, forming an acute angle with respect to the first blade surface, forms the first cutting surface.

A second cutting element rotates about a second rotational axis and contacts the edge portion to form a second cutting surface along at least a portion of the edge portion on a second blade surface of the blade stock. The second cutting surface is formed parallel to the second rotational axis in a plane, so that the second cutting surface intersects the first cutting surface to form the cutting edge. Preferably, a working surface of the second cutting element, forming an acute angle with respect to the second blade surface, forms the second cutting surface.

In one preferred embodiment of this invention, the blade stock is moved with respect to the first cutting element and the edge portion contacts the first cutting element to form a first cutting surface that defines a cutting edge along a line of the edge portion. The first rotational axis is oriented in a skewed position with respect to the line. A second cutting element is rotated about a second rotational axis oriented in a skewed position with respect to the line. The blade stock is moved with respect to the second cutting element and the edge portion is contacted with the second cutting element. Each of the first cutting surface and the second cutting surface is formed to have one of a planar surface and an arcuate surface.

In one preferred embodiment of this invention, the edge portion contacts the first cutting element to form a first cutting surface that defines a cutting edge along an arc segment of the edge portion. The first rotational axis is oriented in a skewed position with respect to a line that is tangent to the arc segment. A second cutting element rotates about a second rotational axis oriented in a skewed position with respect to the line. The blade stock is moved with respect to the second cutting element and the edge portion contacts the second cutting element. Each of the first cutting surface and the second cutting surface is formed to have one of a planar surface and an arcuate surface.

In one preferred embodiment of this invention, the edge portion of the blade stock contacts the first cutting element at a first contacting line defined along a width of the first cutting element, generally perpendicular with respect to the edge portion, and forms a first cutting surface along the edge portion on a first blade surface of the blade stock. The edge portion is moved with respect to a second cutting element rotating about a second rotational axis and contacts the second cutting element at a second contacting line defined along a width of the second cutting element, generally perpendicular with respect to the edge portion, and forms a second cutting surface along the edge portion on a second blade surface of the blade stock so that the second cutting surface intersects the first cutting surface.

In one preferred embodiment of this invention, an arrowhead blade having a cutting edge formed along at least a portion of an edge portion of the arrowhead blade includes a first cutting surface formed on a first blade surface of the arrowhead blade along at least a portion of the edge portion by contacting the edge portion and a first cutting element rotating about a first rotational axis. The arrowhead blade further includes a second cutting surface formed on a second blade surface of the arrowhead blade along at least a portion of the edge portion by contacting the edge portion and a second cutting element rotating about a second rotational axis, so that the second cutting surface intersects the first cutting surface. In one preferred embodiment of this invention, at least a portion of at least one of the first cutting surface and the second cutting surface is planar. Preferably, at least a portion of at least one of the first cutting surface and the second cutting surface is smooth. Additionally, or alternatively, at least a portion of at least one of the first cutting surface and the second cutting surface includes a plurality of striations along a length of the cutting surface generally parallel to the cutting edge.

DESCRIPTION OF THE DRAWINGS

The drawings illustrate different features of an apparatus and a method for forming a cutting edge along an edge portion of a blade stock according to preferred embodiments of this invention, wherein.

DETAILED DESCRIPTION OF PREFERRED EMBODIMENTS

Figure 1:
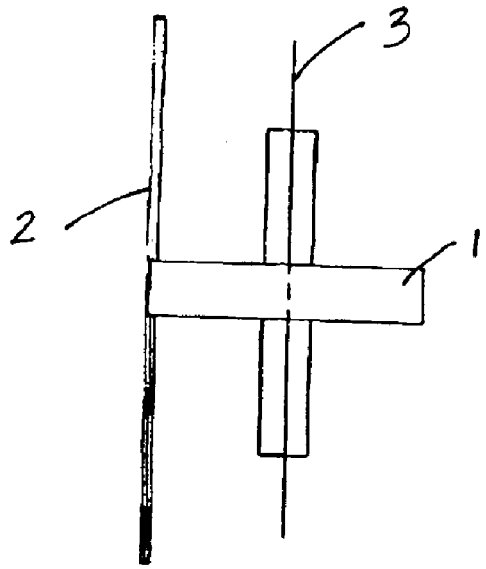
FIG. 1 PRIOR ART
FIGS. 1–4 illustrate a top view, a front view, a side view and a perspective view, respectively, of a conventional cutting element rotatable about a rotational axis parallel to an edge portion of a blade.
Figure 2:
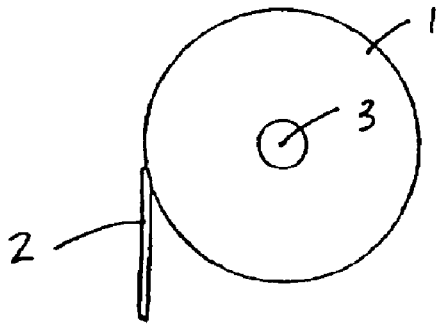
FIG. 2 PRIOR ART
Figure 3:
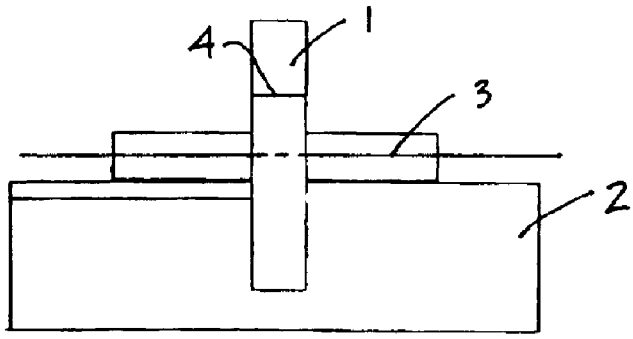
FIG. 3 PRIOR ART
Figure 4:
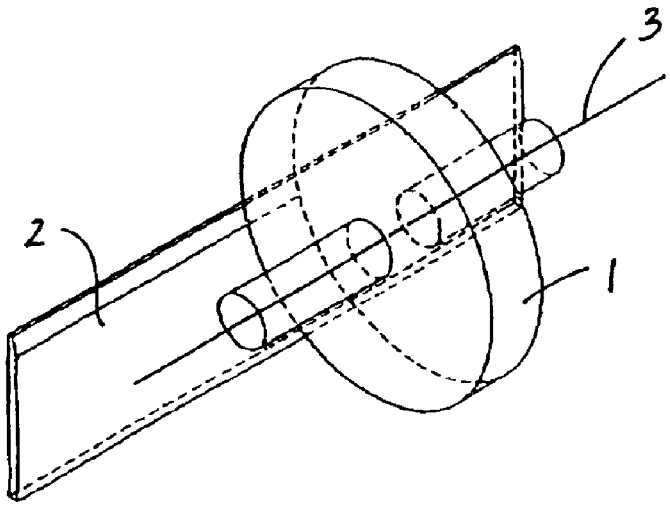
FIG. 4 PRIOR ART
Figure 5:
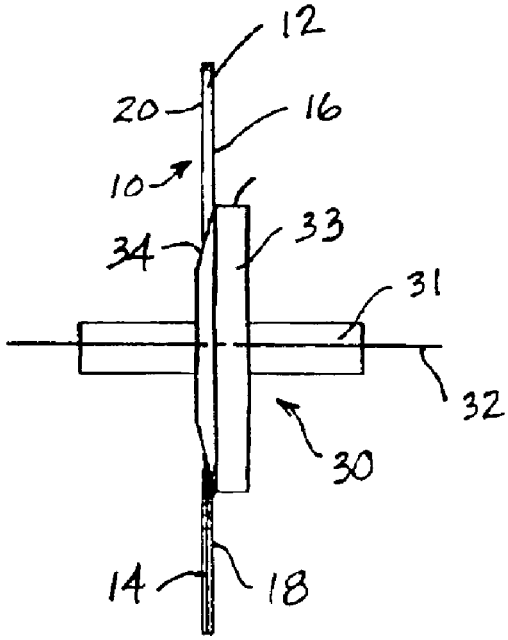
FIGS. 5–8 illustrate a top view, a front view, a side view and a perspective view, respectively, of a cutting element contacting an edge portion of a blade stock and forming a cutting surface on the edge portion, according to one preferred embodiment of this invention.
Figure 6:
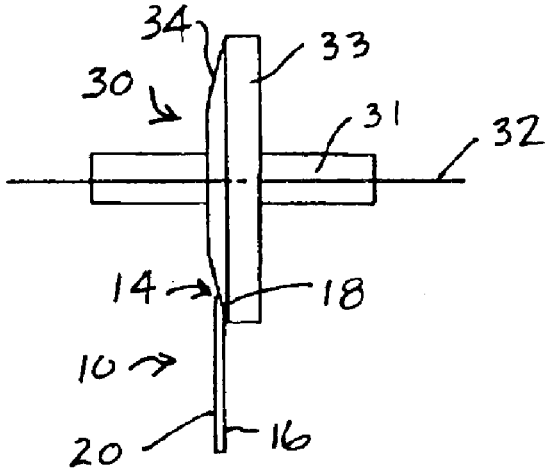
Figure 7:
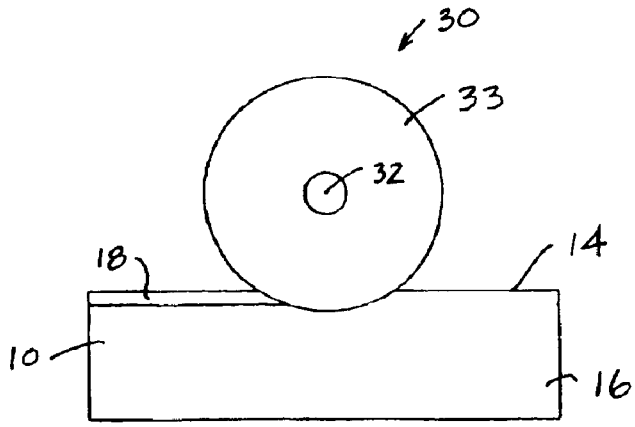

This invention is directed to a method for forming a cutting edge 14 along an edge portion 12 of a blade stock 10. Blade stock 10 comprises a first blade surface 16 and an opposing second blade surface 20. A first cutting surface 18 is formed on first blade surface 16 and a second cutting surface 22 is formed on second blade surface 20, which intersects first cutting surface 18 to form cutting edge 14 along edge portion 12. Preferably, blade stock 10 is made of a suitable metal material. Other materials suitable for blade stock 10 include, but are not limited to, alloys, plastics, graphite materials and different metal and/or non-metal composite materials.

Although the various aspects and embodiments of this invention will be described in the context of an archery arrowhead, and more particularly described, without limitation and by way of illustration only, in the context of an archery arrowhead blade 100, it is apparent that the methods of this invention are equally adaptable for forming functional and/or decorative shaped edges on any suitable stock piece.

In one preferred embodiment of this invention as shown in FIGS. 5–27, blade stock 10 is positioned with respect to a cutting mechanism or apparatus including at least one cutting element, for example a grinding wheel having a cutting surface. The cutting mechanism or apparatus preferably comprises at least one rotatable cutting element, which moves with respect to blade stock 10. The phrase moved with respect to as used throughout this specification and in the claims refers to relative movement of blade stock 10 with respect to at least one of first cutting element 30 and a second cutting element 40. For example, it is apparent to those skilled in the art that in various preferred embodiments of this invention blade stock 10 moves while first cutting element 30 rotates in a stationary or fixed position; blade stock 10 is in a stationary or fixed position while first cutting element 30 rotates and moves relative to blade stock 10; or both blade stock 10 and first cutting element 30 move relative to each other, as first cutting element 30 rotates about a rotational axis.

Referring to FIGS. 5–12 for example, blade stock 10 is moved with respect to a first cutting element 30, which rotates about a first rotational axis 32. Preferably, but not necessarily, first cutting element 30 comprises a shaft 31 that defines or is positioned along first rotational axis 32. For example, in one preferred embodiment of this invention, first cutting element 30 comprises a grinding wheel 33 attached to shaft 31 having a grinding or working surface 34. Preferably, but not necessarily, at least a portion of grinding wheel 33 is generally cylindrical or conical. It is apparent that grinding wheel 33 may have any suitable shape known to those having ordinary skill in the art. Grinding wheel 33 contacts first blade surface 16 to form first cutting surface 18 by grinding first blade surface 16 along at least a portion of edge portion 12. Working surface 34 preferably forms an acute angle with respect to first blade surface 16 and grinds first blade surface 16 to form first cutting surface 18.

Referring to FIGS. 13–24 for example, in one preferred embodiment of this invention, first rotational axis 32 is oriented with respect to edge portion 12 in a skewed position with respect to a line 24 formed along edge portion 12 of blade stock 10. The terms skew and skew lines refer to lines which do not lie in the same plane in three-dimensional space. Each of FIGS. 8, 12, 16, 20 and 24 includes a coordinate system indicating a x-axis 60, a y-axis 70 and a z-axis 80 corresponding to three-dimensional space. Throughout this description of preferred embodiments a plane defined by an intersection of the x-axis and the y-axis may be referred to as a xy-plane. Similarly, a plane defined by an intersection of the y-axis and the z-axis may be referred to as a yz-plane and a plane defined by an intersection of the x-axis and the z-axis may be referred to as a xz-plane. For example, in one preferred embodiment of this invention as shown in FIGS. 9–16, first cutting element 30 rotates about first rotational axis 32 within a cutting plane defined by first rotational axis 32 of first cutting element 30 positioned or fixed within or parallel to the xy-plane.

Figure 8:
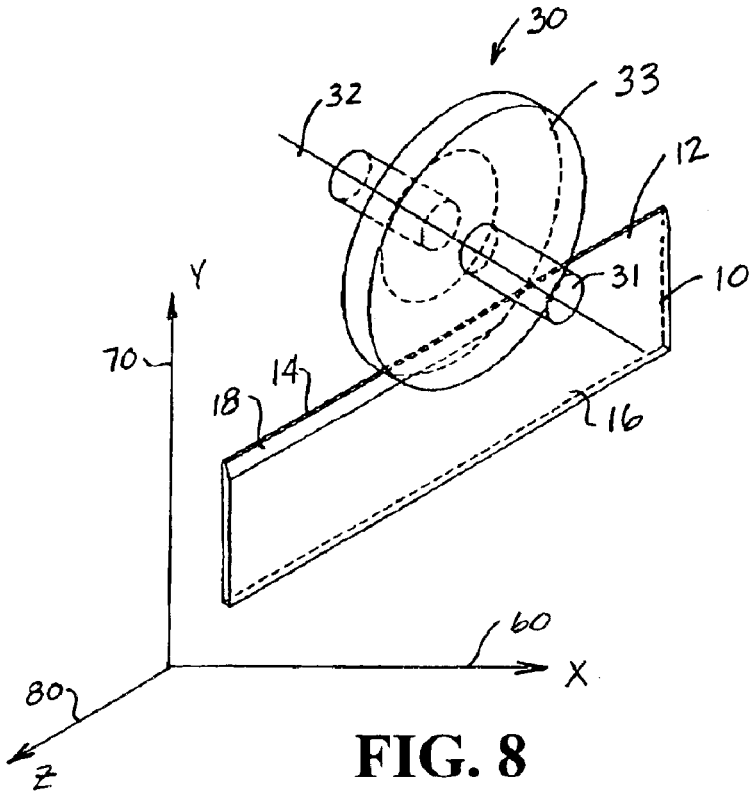
Figure 9:
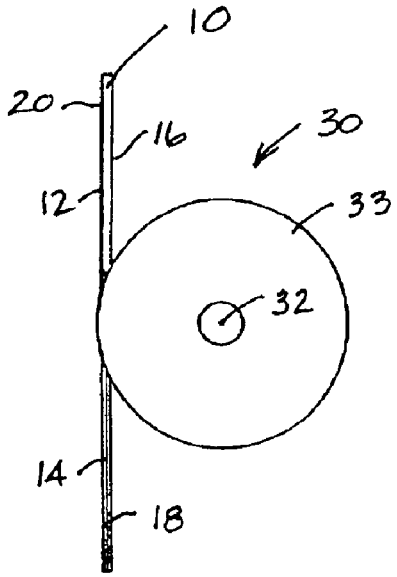
FIGS. 9–12 illustrate a top view, a front view, a side view and a perspective view, respectively, of a cutting element contacting an edge portion of a blade stock and forming a cutting surface on the edge portion, according to one preferred embodiment of this invention.
Figure 10:
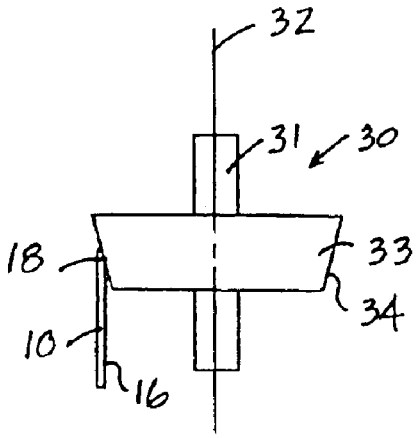
Figure 11:
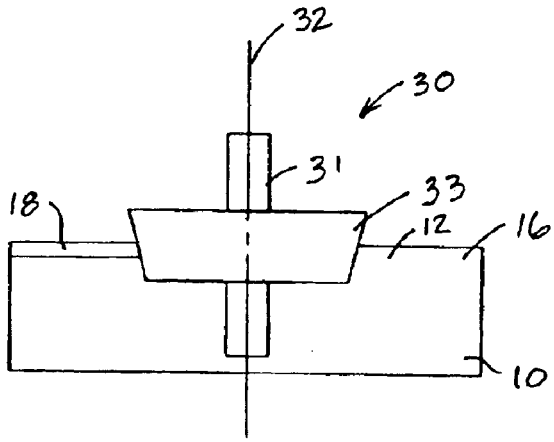
Figure 12:
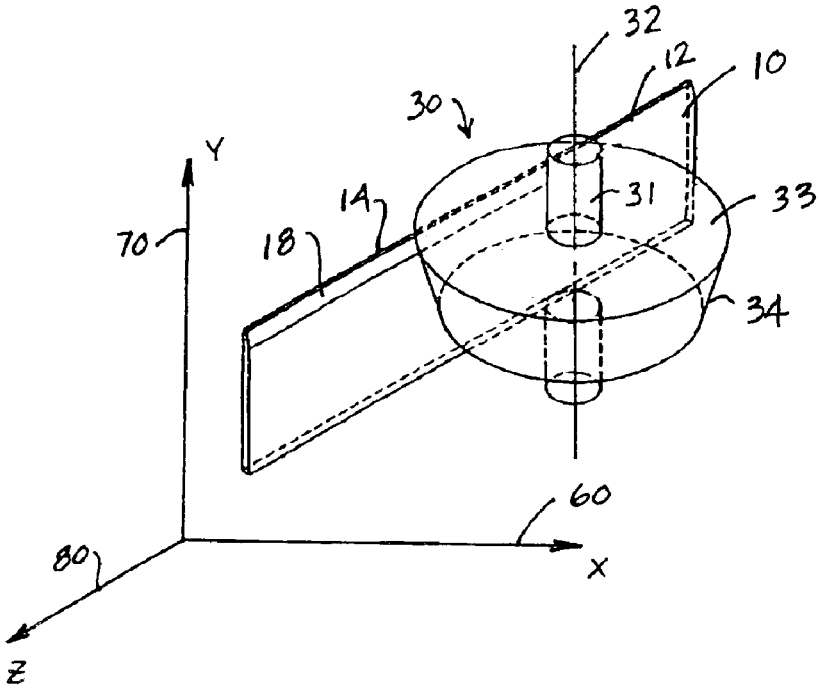
Figure 13:
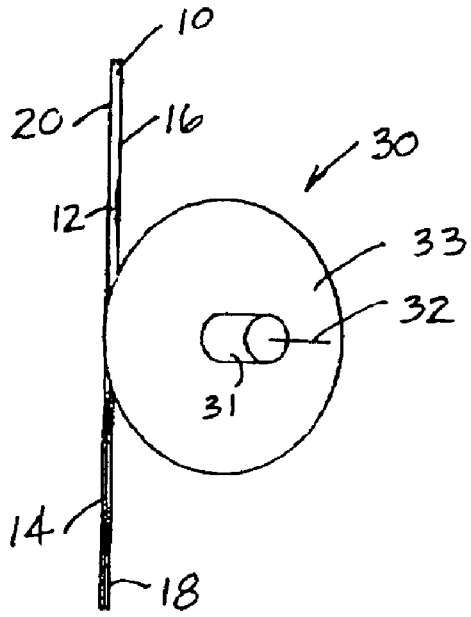
FIGS. 13–16 illustrate a top view, a front view, a side view and a perspective view, respectively, of a cutting element contacting an edge portion of a blade stock and forming a cutting surface on the edge portion, according to one preferred embodiment of this invention.
Figure 14:
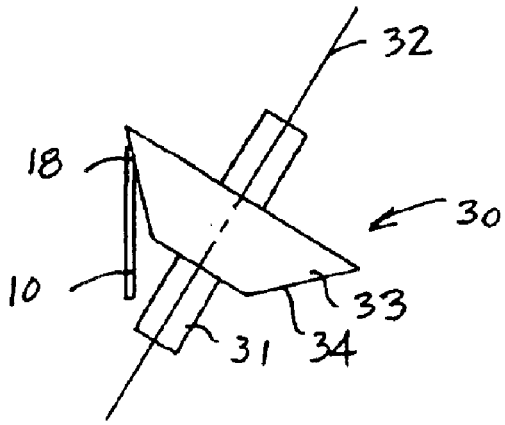
Figure 15:
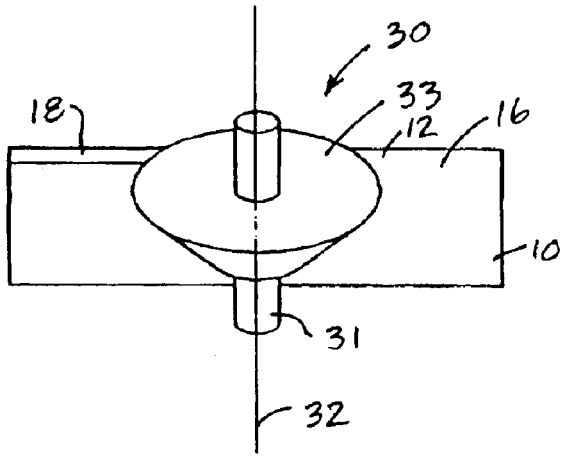
Figure 16:
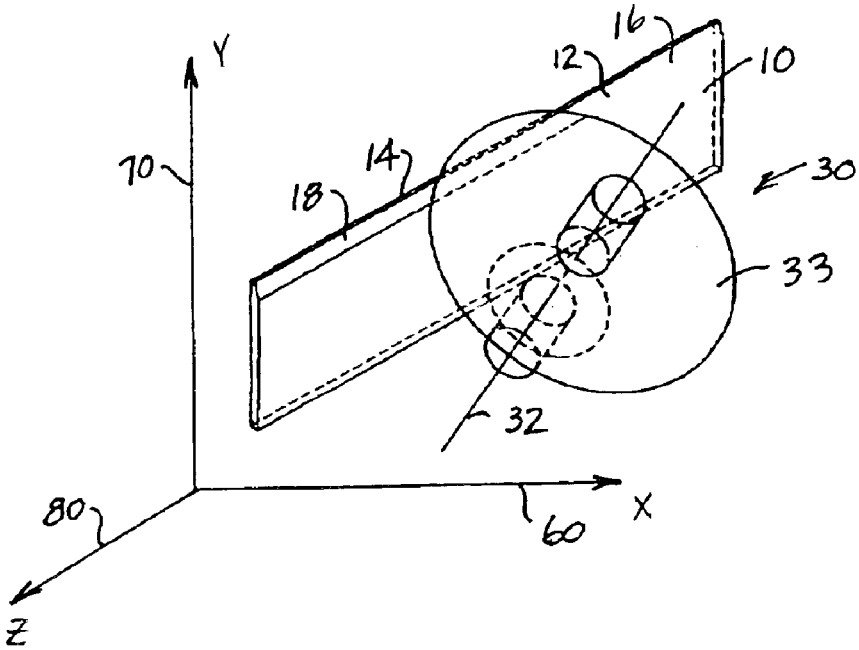
Figure 17:
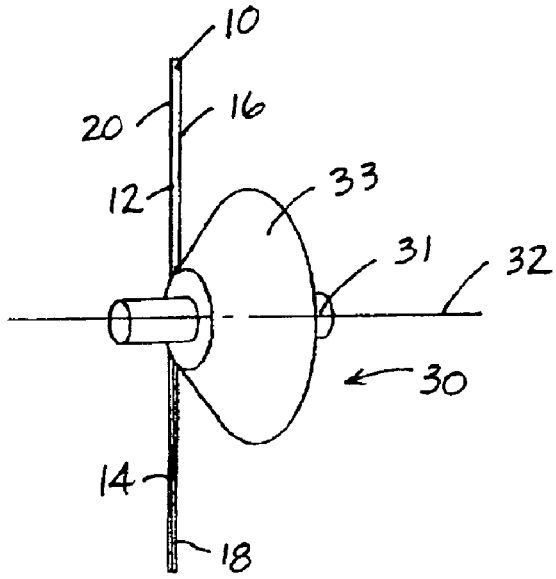
FIGS. 17–20 illustrate a top view, a front view, a side view and a perspective view, respectively, of a cutting element contacting an edge portion of a blade stock and forming a cutting surface on the edge portion, according to one preferred embodiment of this invention.
Figure 18:
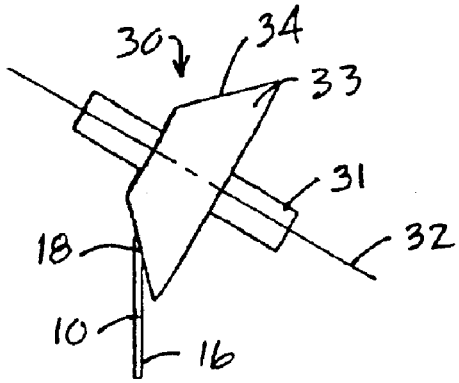
Figure 19:
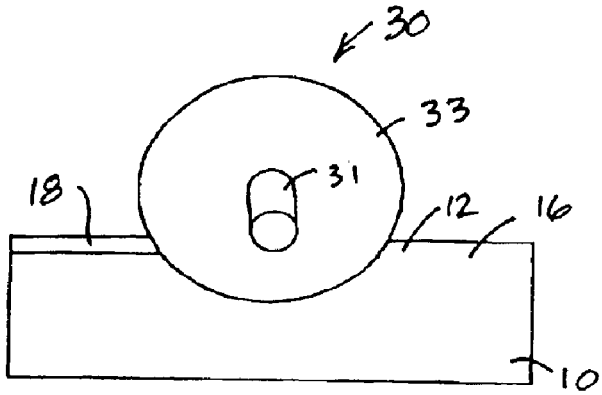
Figure 20:
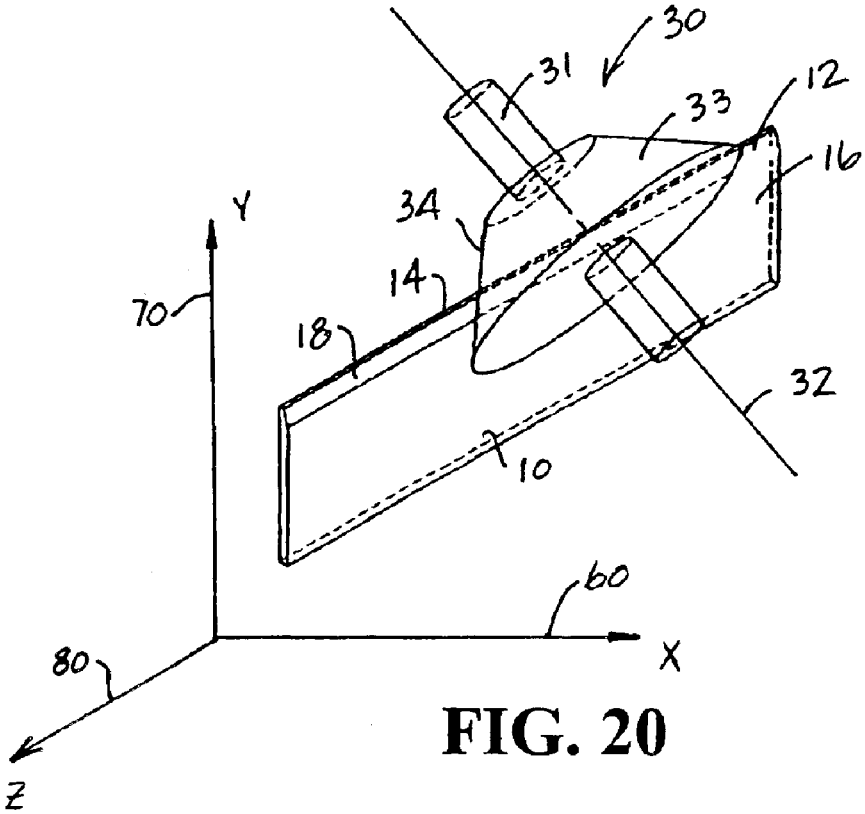
Figure 21:
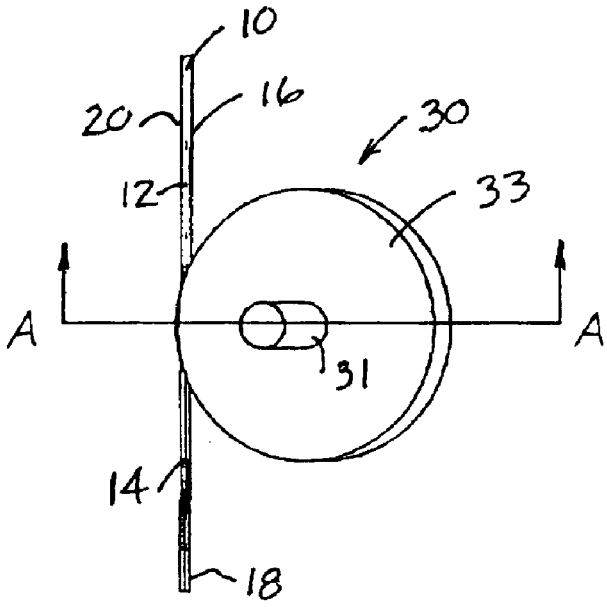
FIGS. 21–24 illustrate a top view, a front view, a side view and a perspective view, respectively, of a cutting element contacting an edge portion of a blade stock and forming a cutting surface on the edge portion, according to one preferred embodiment of this invention.
Figure 22:
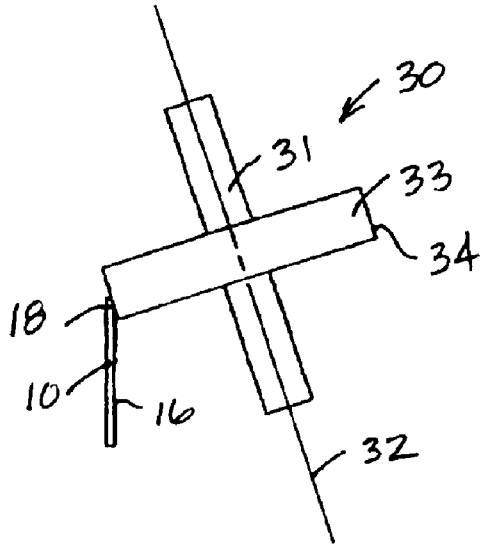
Figure 23:
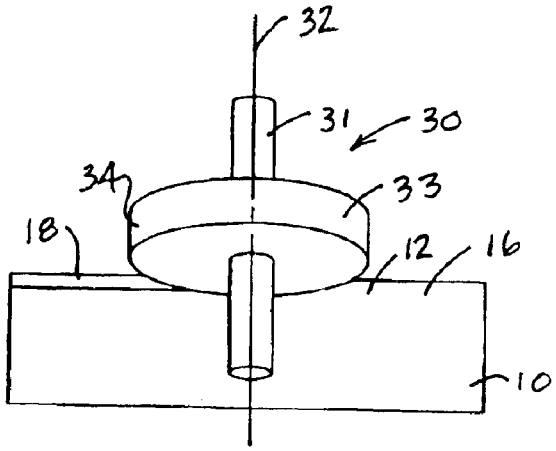
Figure 24:
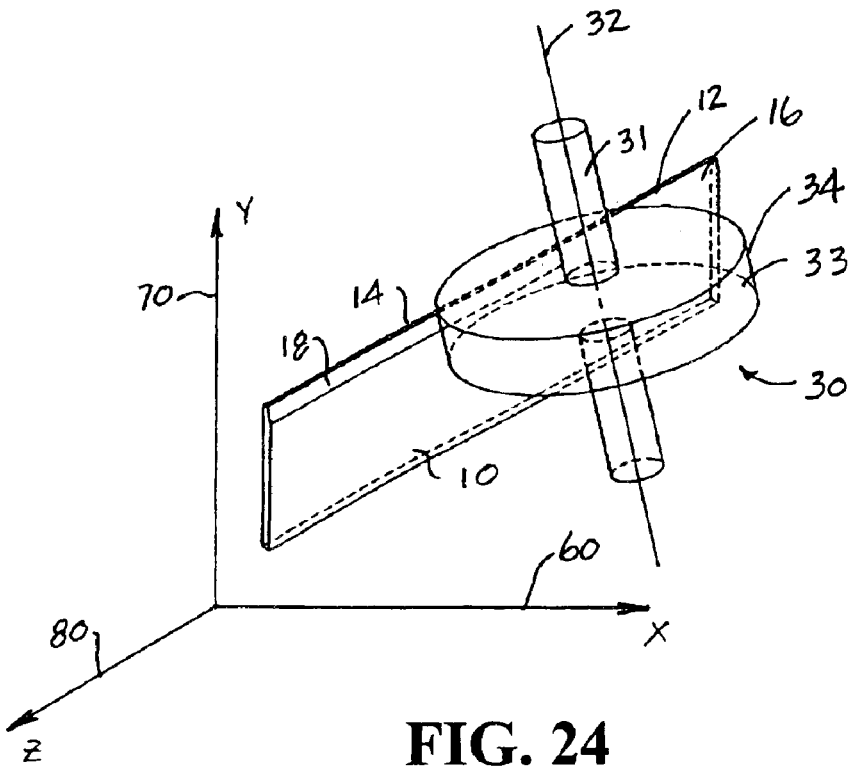

In one preferred embodiment of this invention, first rotational axis 32 forms one of an acute angle and a perpendicular angle with respect to cutting edge 14. For example, as shown in FIG. 8, cutting edge 14 is generally positioned along or parallel to z-axis 80 and first rotational axis 32 forms a perpendicular angle with respect to a plane in which cutting edge 14 lies, such as the yz-plane. Alternatively, first rotational axis 32 forms an acute angle with respect to cutting edge 14, as shown in FIG. 16. For example, first rotational axis 32 forms an acute angle with respect to a plane in which cutting edge 14 lies, such as the yz-plane.

With edge portion 12 moving with respect to first cutting element 30 and first cutting element 30 rotating about first rotational axis 32, edge portion 12 contacts first cutting element 30 and forms first cutting surface 18 on first blade surface 16. First cutting surface 18 is formed along at least a portion of edge portion 12. Preferably, but not necessarily, first cutting surface 18 is formed along a length of blade stock 10. As discussed above, blade stock 10 can move relative to first cutting element 30 while first cutting element 30 rotates in a stationary position; blade stock 10 can be fixed in a stationary position while first cutting element 30 moves relative to blade stock 10; or each of blade stock 10 and first cutting element 30 can move relative to the other. In one preferred embodiment of this invention as shown for example in FIGS. 5–24, edge portion 12 is generally linear and moves with respect to first cutting element 30 in a generally linear direction along or parallel to the z-axis 80. In alternative embodiments of this invention wherein edge portion 12 is generally non-linear, such as when edge portion 12 forms an arcuate-shaped profile along the z-axis 80, edge portion 12 may move in a non-linear path with respect to first cutting element 30.

Preferably, but not necessarily, first cutting surface 18 is a generally planar surface, as shown in FIGS. 5–24, as a result of working surface 34 of first cutting element 30 having a flat or linear cross-sectional width. Further, first cutting surface 18 preferably is smooth or void of perpendicular grinding lines apparent in cutting surfaces formed using conventional methods. A smooth, planar cutting surface may assist in reducing drag on the arrowhead during flight as well as reducing frictional interference at contact. However, it is apparent to those having ordinary skill in the art that working surface 34 may have any other suitable non-linear profile, such as an arcuate profile, which forms a corresponding first cutting surface 18 along edge portion 12 having a non-linear or arcuate cross-sectional profile. Further, it may be desirable to form first cutting surface 18 having a plurality of striations along a length of first cutting surface 18 and generally parallel to edge portion 12.

Second cutting surface 22 may be formed on second blade surface 20, opposing first blade surface 16, using first cutting element 30. For example, blade stock 10 may be moved with respect to first cutting element 30 so that first cutting element 30 contacts second blade surface 20 and forms second cutting surface 22, similar to the method for forming first cutting surface 16. Second cutting surface 22 intersects first cutting surface 18 to form cutting edge 14 along edge portion 12 of blade stock 10.

Alternatively, blade stock 10 may move with respect to second cutting element 40 generally opposing first cutting element 30. Blade stock 10 can move with respect to second cutting element 40 to form second cutting surface 22 as it moves with respect to first cutting element 30 to form first cutting surface 18. Preferably, but not necessarily, second cutting element 40 is the same or similar to first cutting element 30, as discussed above.

Figure 25:
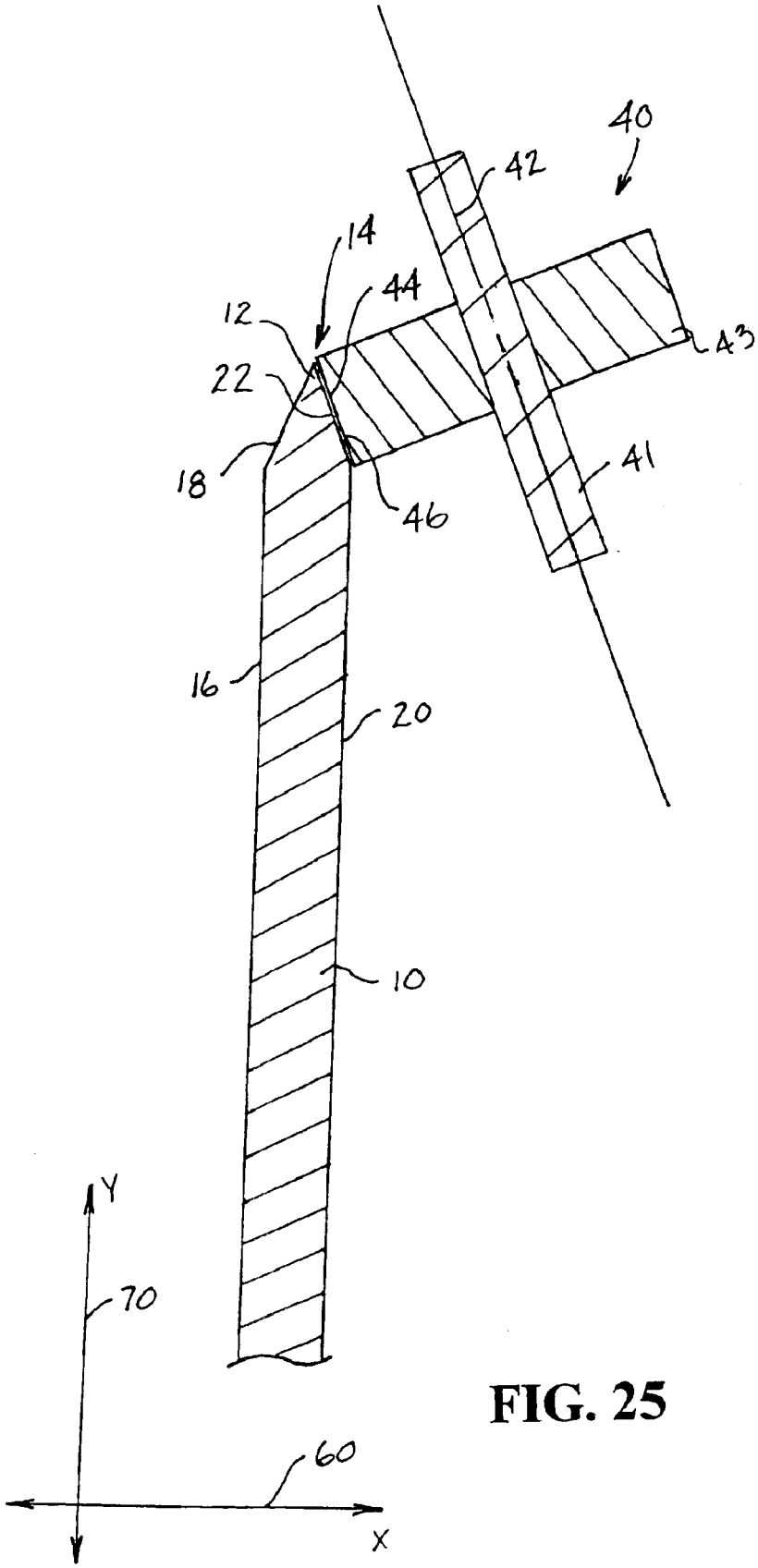
FIG. 25 is a sectional view taken along line A—A shown in FIG. 21 of the cutting element contacting the blade stock, illustrating a contacting line defined along a width of the cutting element, which contacts the edge portion of the blade stock and forms the cutting surface, according to one preferred embodiment of this invention.

Referring to FIG. 25 for example, blade stock 10 moves with respect to second cutting element 40 rotating about second rotational axis 42. Preferably, but not necessarily, second cutting element 40 comprises a shaft 41 that defines or is positioned along second rotational axis 42. For example, in one preferred embodiment of this invention, second cutting element 40 comprises a grinding wheel 43 attached to shaft 41 having a grinding or working surface 44. Second cutting surface 22 is formed by grinding second blade surface 20 along at least a portion of edge portion 12 as working surface 44 contacts second blade surface 20. Preferably, working surface 44 forms an acute angle with respect to second blade surface 20, as shown in FIG. 25, and second rotational axis 42 is oriented in a skewed position with respect to cutting edge 14. For example, working surface 44 may contact second blade surface 20 at an acute angle. Second cutting surface 22 is formed along edge portion 12 so that second cutting surface 22 intersects first cutting surface 18 to form cutting edge 14.

In one preferred embodiment of this invention as shown for example in FIG. 25, at least one of first rotational axis 32 and second rotational axis 42 preferably is parallel to first cutting surface 18 or second cutting surface 22, respectively. For example, FIG. 25 illustrates second rotational axis 42 parallel to second cutting surface 22. As a result, working surface 44 is parallel to second cutting surface 22 and second rotational axis 42. Thus, second cutting surface 22 is formed as a generally planar surface. Preferably, but not necessarily, the planar second cutting surface 22 is smooth. Alternatively, second cutting surface 22 may comprise a plurality of striations along a length of second cutting surface 22 and generally parallel to edge portion 12.

Referring further to FIG. 25, a contacting line 46 is defined on a cross-sectional area of second cutting element 40 and formed along a width of working surface 44. Preferably, contacting line 46 is generally perpendicular to an edge line formed along edge portion 12 and forms second cutting surface 22 having a width that corresponds to a length of contacting line 46. Because contacting line 46 is generally perpendicular to edge portion 12, a smooth second cutting surface 22 is formed. Conversely, in conventional grinding methods as shown in FIGS. 1–4, a contacting line 4 defined along a width of a grinding wheel surface is parallel to the edge portion. As a result, as the edge portion is moved relative to the grinding wheel in conventional methods, perpendicular grinding lines are formed on the cutting surface. Such perpendicular grinding lines can increase arrowhead drag as the conventional archery arrow is in flight, as well as produce undesirable frictional interference upon contact with a target.

Figure 26:
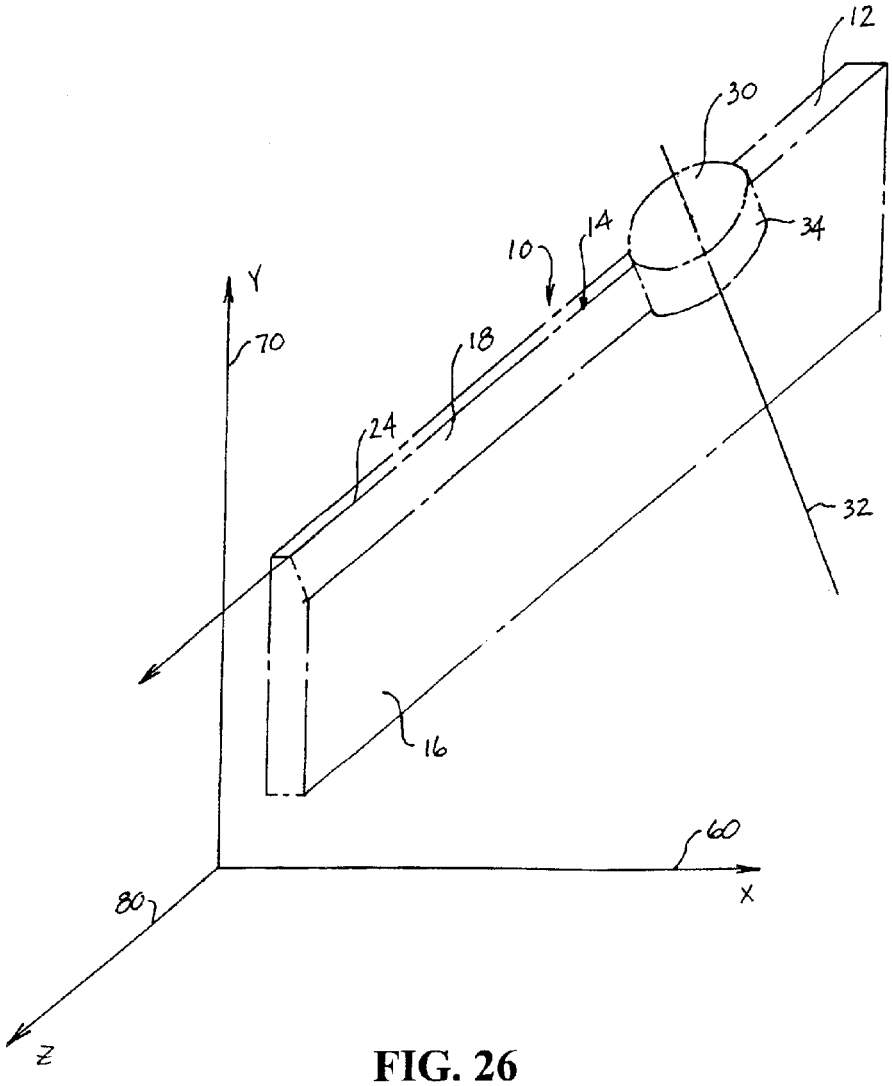
FIG. 26 is a perspective view of an edge portion of a blade stock contacting a cutting element to form a cutting surface that defines a cutting edge along a line of the edge portion, wherein the cutting element rotates about a rotational axis oriented in a skewed position with respect to the line, according to one preferred embodiment of this invention.

In one preferred embodiment of this invention as shown in FIG. 26, edge portion 12 may be generally linear along the z-axis 80. In this preferred embodiment, cutting edge 14 is formed along edge portion 12 by rotating first cutting element 30 about first rotational axis 32 and moving blade stock 10 with respect to first cutting element 30. Edge portion 12 contacts first cutting element 30 to form first cutting surface 18 that defines cutting edge 14 along a line 24 of edge portion 12. As shown in FIG. 26, first rotational axis 32 is oriented in a first skewed position with respect to line 24. Preferably, second cutting element 40 (not shown) rotates about second rotational axis 42 oriented in a second skewed position with respect to line 24. Blade stock 10 is moved with respect to second cutting element 40 and edge portion 12 is contacted with second cutting element 40, thereby forming second cutting surface 22. Each of first cutting surface 18 and second cutting surface 22 can have one of a planar surface and a non-planar surface, such as an arcuate surface. Because first rotational axis 32 and second rotational axis 42 each is defined or oriented in a skewed position with respect to line 24, neither first rotational axis 32 nor second rotational axis 42 lies in a same plane as line 24.

Figure 27:
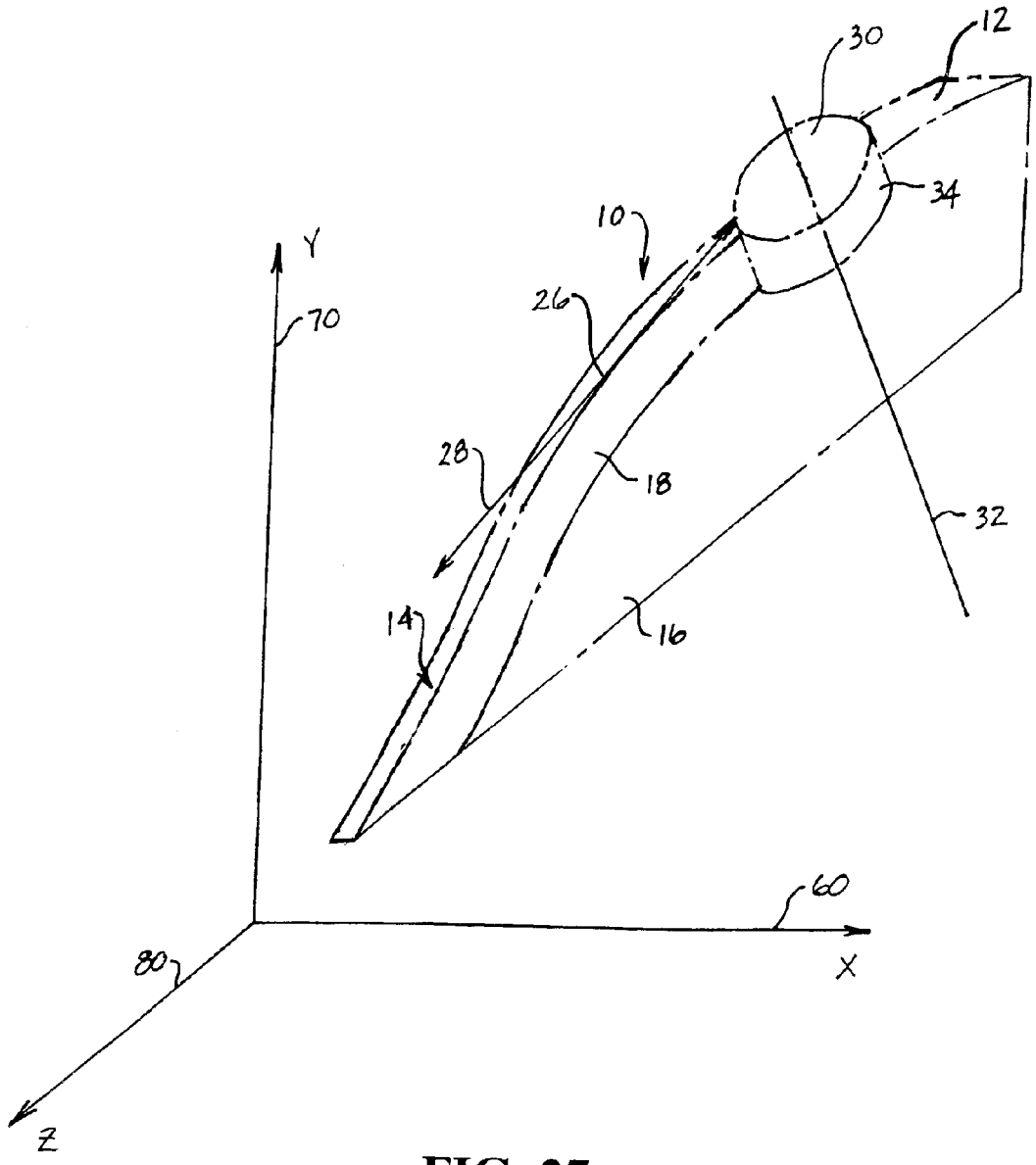
FIG. 27 is a perspective view of an edge portion of a blade stock contacting a cutting element to form a cutting surface that defines a cutting edge along an arc segment of the edge portion, wherein the cutting element rotates about a rotational axis oriented in a skewed position with respect to a line that is tangent to the arc segment, according to one preferred embodiment of this invention.

Alternatively, in one preferred embodiment of this invention as shown for example in FIG. 27, edge portion 12 may have a non-linear profile along or parallel with the z-axis 80. For example, edge portion 12 may have a curved or arcuate profile along the z-axis 80. First cutting element 30 is rotated about first rotational axis 32 and blade stock 10 is moved with respect to first cutting element 30. Edge portion 12 is contacted with first cutting element 30 to form first cutting surface 18 that defines cutting edge 14 along an arc segment 26 of edge portion 12, as shown in FIG. 27. Similarly, second cutting element 40 is rotated about second rotational axis 42 and blade stock 10 is moved with respect to second cutting element 40. Edge portion 12 is contacted with second cutting element 40 to form second cutting surface 22 along arc segment 26 of edge portion 12. First rotational axis 32 and second rotational axis 42 each is oriented in a skewed position with respect to a line 28 that is tangent to arc segment 26. First cutting surface 18 and second cutting surface 22 each is formed having one of a planar surface and an arcuate surface. Preferably, but not necessarily, first cutting surface 18 is the same or similar to second cutting surface 22.

In one preferred embodiment of this invention as shown in FIGS. 21–25, a planar first cutting surface 18 and a planar second cutting surface 22 intersecting first cutting surface 18 form cutting edge 14. Cutting edge 14 is formed along edge portion 12 of blade stock 10 by moving edge portion 12 with respect to first cutting element 30, which rotates about first rotational axis 32. Edge portion 12 can be generally linear or non-linear, for example having an arcuate profile with respect to the z-axis. Edge portion 12 contacts first cutting element 30 to form first cutting surface 18 along at least a portion of edge portion 12 on first blade surface 16 of blade stock 10. As shown in FIGS. 21–24, first cutting surface 18 is formed parallel to first rotational axis 32 in a plane, preferably the xy-plane or a plane parallel to the xy-plane. Preferably, in the defined plane working surface 34 forms an acute angle with respect to first blade surface 16 to form first cutting surface 18.

Second cutting element 40 rotates about second rotational axis 42 and contacts edge portion 12 to form second cutting surface 22 along at least a portion of edge portion 12 on second blade surface 20. As shown in FIG. 25, second cutting surface 22 is formed parallel to second rotational axis 42 in a plane parallel to the xy-plane, so that second cutting surface 22 intersects first cutting surface 18, thus forming cutting edge 14 on edge portion 12. Preferably, working surface 44 forms an acute angle with respect to second blade surface 20 to form second cutting surface 22.

Referring further to FIG. 25, in one preferred embodiment of this invention cutting edge 14 is formed along edge portion 12 of blade stock 10 by moving edge portion 12 with respect to first cutting element 30 rotating about first rotational axis 32 and contacting edge portion 12 and first contacting line 36 defined along the width of first cutting element 30. Preferably, contacting line 36 is generally perpendicular with respect to edge portion 12 to form first cutting surface 18 along edge portion 12 on first blade surface 16. Edge portion 12 can also be moved with respect to second cutting element 40, rotating about second rotational axis 42, to contact a second contacting line 46 defined along a width of second cutting element 40. Preferably, second contacting line 46 is generally perpendicular with respect to edge portion 12 to form second cutting surface 22 along edge portion 12 on second blade surface 20 so that second cutting surface 22 intersects first cutting surface 18.

Figure 28:
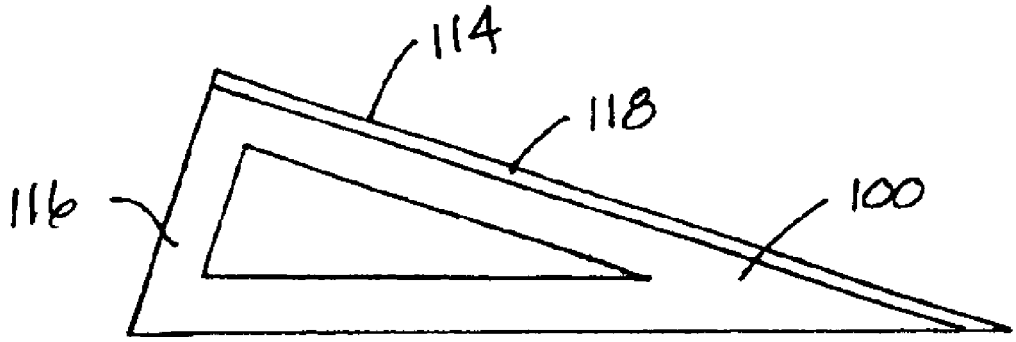
FIG. 28 is a side view of an arrowhead blade having a cutting edge formed by a method according to one preferred embodiment of this invention.
Figure 29:
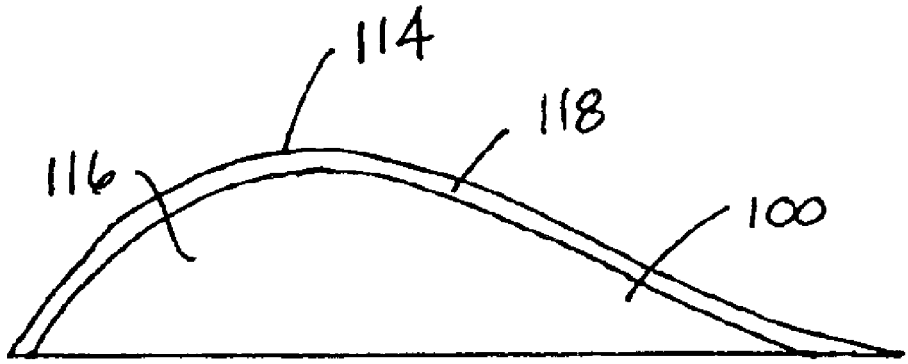
FIG. 29 is a side view of an arrowhead blade having a cutting edge formed by a method according to one preferred embodiment of this invention.
Figure 30:
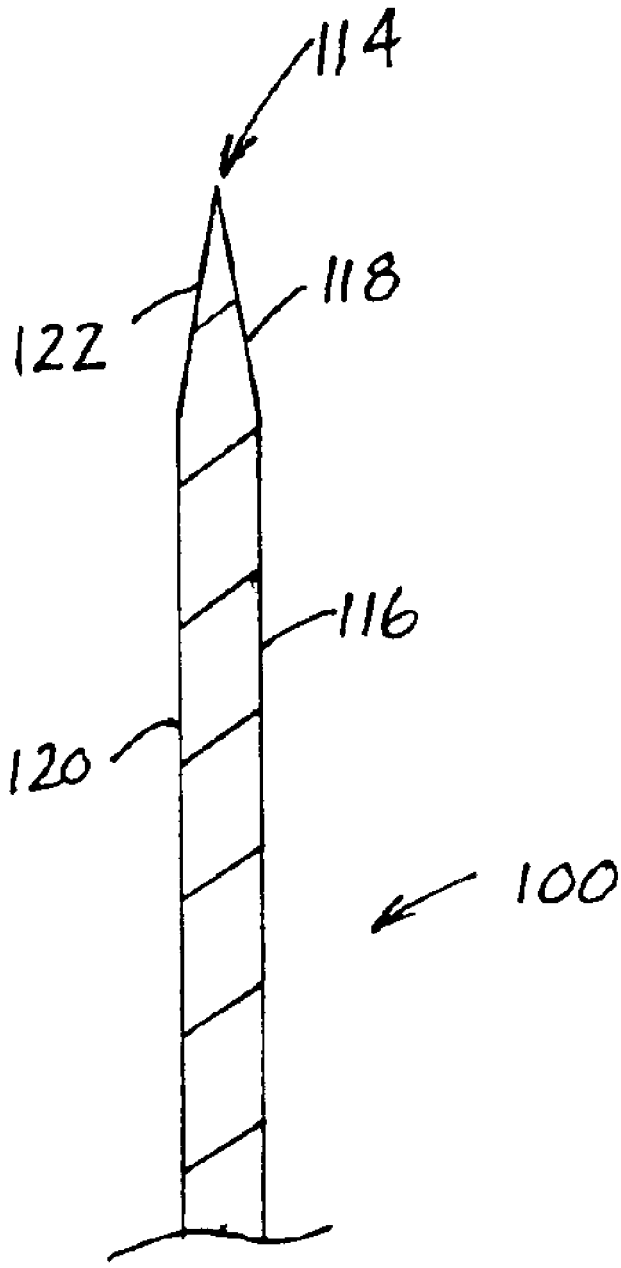
FIG. 30 is a cross-sectional view of an arrowhead blade having a cutting edge formed by a method according to one preferred embodiment of this invention.

Referring to FIGS. 28–30, an arrowhead blade 100 comprises a cutting edge 114 formed by one method according to the various preferred embodiments of this invention. Arrowhead blade 100 comprises cutting edge 114 formed along at least a portion of edge portion 112 of arrowhead blade 100. Cutting edge 114 comprises a first cutting surface 118 formed on a first blade surface 116 of arrowhead blade 100 along at least a portion of edge portion 112 and a second cutting surface 122 formed on a second blade surface 120 of arrowhead blade 100 along at least a portion of edge portion 112, so that second cutting surface 122 intersects first cutting surface 118. In one preferred embodiment of this invention, at least a portion of at least one of first cutting surface 118 and second cutting surface 122 is planar. Preferably, but not necessarily, at least a portion of at least one of first cutting surface 118 and second cutting surface 122 is smooth. In alternative preferred embodiments of this invention, it may be desirable for at least a portion of at least one of first cutting surface 118 and second cutting surface 122 to comprise a plurality of striations formed along a length of cutting surface 118, 122 and desirably generally parallel to cutting edge 114.

In drawings showing cross-sectional views of various embodiments of this invention, cross-hatching may indicate that various elements of this invention comprise a particular material. However, it is apparent to those skilled in the art that the elements may comprise any suitable material, including but not limited to metals, alloys, plastics, graphite materials and different metal and/or non-metal composite materials.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. A method for forming a cutting edge along an edge portion of a blade stock, the method comprising:

moving said blade stock with respect to a first cutting element rotating about a first rotational axis, said first rotational axis forming one of an acute angle and a perpendicular angle with respect to said cutting edge;

contacting said edge portion and said first cutting element and forming a first cutting surface along said edge portion;

moving said blade stock with respect to a second cutting element rotating about a second rotational axis, said second rotational axis forming one of an acute angle and a perpendicular angle with respect to said cutting edge; and contacting said edge portion and said second cutting element and forming a second cutting surface along said edge portion so that said second cutting surface intersects said first cutting surface to form said cutting edge.

2. The method according to claim 1, wherein said first cutting element comprises a grinding wheel.

3. The method according to claim 1, wherein said first cutting element rotates about said first rotational axis generally perpendicular to said cutting edge.

4. The method according to claim 1, wherein said first cutting element rotates about said first rotational axis within a vertical cutting plane defined by said first cutting element.

5. The method according to claim 1, wherein said edge portion moves with respect to said first cutting element in a generally linear direction.

6. The method according to claim 1, wherein at least a portion of said first cutting surface is formed as a planar surface.

7. The method according to claim 1, wherein said first cutting surface is formed by grinding a first blade surface of said blade stock along at least a portion of said edge portion.

8. The method according to claim 7, wherein a working surface of said first cutting element forming an acute angle with respect to said first blade surface grinds said first blade surface.

9. The method according to claim 1, wherein said second cutting surface is formed by grinding a second blade surface of said blade stock along at least a portion of said edge portion.

10. The method according to claim 9, wherein a working surface of said second cutting element forming an acute angle with respect to said second blade surface grinds said second blade surface.

11. The method according to claim 1, wherein contacting said edge portion and said first cutting element forms a generally smooth first cutting surface.

12. The method according to claim 1, wherein contacting said edge portion and said first cutting element forms a plurality of striations along a length of said first cutting surface.

13. The method according to claim 1, wherein said blade stock moves and said first cutting element is stationary.

14. The method according to claim 1, wherein said blade stock is stationary and said first cutting element moves.

15. The method according to claim 1, wherein each of said blade stock and said first cutting element moves.

16. The method according to claim 2, wherein the blade stock is formed into an arrowhead blade.

17. A method for forming a cutting edge along an edge portion of a blade stock, the method comprising:

moving said edge portion with respect to a first cutting element rotating about a first rotational axis;

contacting said edge portion and said first cutting element and forming a first cutting surface along at least a portion of said edge portion on a first blade surface of said blade stock, in a plane said first cutting surface formed parallel to said first rotational axis;

a second cutting element rotating about a second rotational axis; and contacting said edge portion and said second cutting element and forming a second cutting surface along at least a portion of said edge portion on a second blade surface of said blade stock, said second cutting surface formed parallel to said second rotational axis, so that said second cutting surface intersects said first cutting surface.

18. The method according to claim 17, wherein a working surface of said first cutting element forming an acute angle with respect to said first blade surface forms said first cutting surface.

19. The method according to claim 17, wherein said first cutting element comprises a wheel.

20. The method according to claim 17, wherein said first cutting element rotates about said first rotational axis generally perpendicular to said cutting edge.

21. The method according to claim 17, wherein said edge portion is generally linear.

22. The method according to claim 17, wherein a working surface of said second cutting element forming an acute angle with respect to said second blade surface forms said second cutting surface.

23. The method according to claim 17, wherein the blade stock is formed into an arrowhead blade.

24. A method for forming a cutting edge along an edge portion of a blade stock, the method comprising:

rotating a first cutting element about a first rotational axis;

moving said blade stock with respect to said first cutting element;

contacting said edge portion with said first cutting element to form a first cutting surface that defines a cutting edge along a line of said edge portion;

orienting said first rotational axis in a skewed position with respect to said line; and rotating a second cutting element about a second rotational axis oriented in a skewed position with respect to said line.

25. The method according to claim 24, wherein said blade stock is moved with respect to said second cutting element.

26. The method according to claim 25, wherein said edge portion is contacted with said second cutting element.

27. The method according to claim 26, wherein said second cutting surface is formed having one of a planar surface and an arcuate surface.

28. The method according to claim 24, wherein said first cutting surface is formed having one of a planar surface and an arcuate surface.

29. A method for forming a cutting edge along an edge portion of a blade stock, the method comprising:

rotating a first cutting element about a first rotational axis;

moving said blade stock with respect to said first cutting element;

contacting said edge portion with said first cutting element to form a first cutting surface that defines a cutting edge along an arc segment of said edge portion; and orienting said first rotational axis in a skewed position with respect to a line that is tangent to said arc segment.

30. The method according to claim 29, further comprising rotating a second cutting element about a second rotational axis oriented in a skewed position with respect to said line.

31. The method according to claim 30, wherein said blade stock is moved with respect to said second cutting element.

32. The method according to claim 31, wherein said edge portion is contacted with said second cutting element.

33. The method according to claim 32, wherein said second cutting surface is formed having one of a planar surface and an arcuate surface.

34. The method according to claim 29, wherein said first cutting surface is formed having one of a planar surface and an arcuate surface.

35. A method for forming a cutting edge along an edge portion of a blade stock, the method comprising:

moving said edge portion with respect to a first cutting element rotating about a first rotational axis;

contacting said edge portion and a first contacting line defined along a width of said first cutting element, said contacting line generally perpendicular with respect to said edge portion, and forming a first cutting surface along said edge portion on a first blade surface of said blade stock;

moving said edge portion with respect to a second cutting element rotating about a second rotational axis; and contacting said edge portion and a second contacting line defined along a width of said second cutting element, said contacting line generally perpendicular with respect to said edge portion, and forming a second cutting surface along said edge portion on a second blade surface of said blade stock so that said second cutting surface intersects said first cutting surface.

36. An arrowhead blade having a cutting edge formed along at least a portion of an edge portion of said arrowhead blade comprising:

a first cutting surface formed on a first blade surface of said arrowhead blade along at least a portion of said edge portion by contacting said edge portion and a first cutting element rotating about a first rotational axis, said first rotational axis forming one of an acute angle and a perpendicular angle with respect to said first blade surface; and a second cutting surface formed on a second blade surface of said arrowhead blade along at least a portion of said edge portion by contacting said edge portion and a second cutting element rotating about a second rotational axis, said second rotational axis forming one of an acute angle and a perpendicular angle with respect to said second blade surface, so that said second cutting surface intersects said first cutting surface.

37. The arrowhead blade according to claim 36, wherein at least a portion of at least one of said first cutting surface and said second cutting surface is planar.

38. The arrowhead blade according to claim 36, wherein at least a portion of at least one of said first cutting surface and said second cutting surface is smooth.

39. The arrowhead blade according to claim 36, wherein at least a portion of at least one of said first cutting surface and said second cutting surface comprises a plurality of striations along a length of said cutting surface.

* * * * *